United States Patent [19]

Johnske

[11] Patent Number: 4,795,083

[45] Date of Patent: Jan. 3, 1989

[54] SLOTTED PARTITION APPARATUS FOR PACKAGING

[75] Inventor: David A. Johnske, Bolingbrook, Ill.

[73] Assignee: Stone Container Corporation, Chicago, Ill.

[21] Appl. No.: 82,731

[22] Filed: Aug. 6, 1987

[51] Int. Cl.[4] ..... B65D 5/48

[52] U.S. Cl. ..... 229/120.36; 217/32; 229/120.35

[58] Field of Search ..... 229/125.35, 125.36; 217/30–33

[56] References Cited

U.S. PATENT DOCUMENTS

| | | | |
|---|---|---|---|
| 179,985 | 7/1876 | Weis | 217/32 |
| 282,899 | 8/1883 | Jaeger | 217/32 |
| 489,664 | 1/1893 | Sheperd | 217/32 |
| 658,930 | 10/1900 | Starman | 217/32 |
| 741,306 | 10/1903 | Carter | 217/32 |
| 786,827 | 4/1905 | Meyer | 217/32 |
| 882,049 | 3/1908 | Carter | 217/32 |
| D. 1,387,782 | 9/1944 | Schwartzberg | 217/30 |
| 3,039,667 | 6/1962 | Kozlik | 229/120.36 |
| 4,685,609 | 8/1987 | Ferrari | 217/32 |

*Primary Examiner*—Stephen Marcus
*Assistant Examiner*—Gary E. Elkins
*Attorney, Agent, or Firm*—Dick and Harris

[57] ABSTRACT

An assembled slotted partition apparatus for repeated use within three dimensional packing containers towards describing containment and cushioning regions therewithin. The apparatus is constructed so as to preclude against its own inadvertent disassembly between and during repeated uses, and relies upon the utilization of primary and secondary interlocking panel members operably receiving one another through the utilization of aligned slots. Primary and spacer locking elements align with each other upon assembly of the primary and secondary panels to describe a partition apparatus in which all structural portions remain intact for reuse in further shipping operations, without any reassembly and/or reattachment of the primary and/or secondary panels to one another.

8 Claims, 2 Drawing Sheets

SLOTTED PARTITION APPARATUS FOR PACKAGING

BACKGROUND OF THE INVENTION

The present invention relates in general to packaging apparata, and in particular to an interlocking slotted partition apparatus for use in describing containment and cushioning regions within a shipping container—where the partitions are reused in the same or similar containers.

A typical prior art partition packing arrangement comprises, in part, a thin first panel having a series of one or more single slots extending downward, in parallel manner, from an edge of the panel to a region halfway along the length of the panel. A number of second panels, equal to the number of slots on the first panel, are slid onto the first panel, each second panel having a simple slot which cooperates with the slot in the first panel. In this way, the first and second panels are caused to intersect, and to have flush upper and lower edges, if the panels are of equal length in the dimension parallel to the line of intersection—provided the slot lengths so permit. By varying the number of first and second panels, and the number of slots in each panel, various arrays of partition packing apparata can be formed, which when placed in a suitably-sized box, yield three dimensional partition packing arrangements.

It is, on occasion, necessary to utilize such a packing arrangement for more than a single shipment. For example, a shipment of half-manufactured items may be sent to a finisher, who then sends the finished items to a packager and/or distributor. A finisher who must unpack the half-manufactured items, and repack them after finishing, would typically desire utilizing the same slotted packing partition. It is at this stage of such a shipping process that the drawbacks of the prior art partition packing arrangements are most discernible. Before the partitions can be reused, they often must be removed from the box to either facilitate unpacking, or to prevent damage to the partitions themselves. In such prior art devices, the panels have typically been maintained together along the simple telescopically nested slots, merely by friction, the presence of the packed items and the constraints of the closed shipping container itself. Upon removal from the box, the panels tend to fall apart from one another immediately, and otherwise tend to become easily separated. Not only is valuable time wasted in rearranging and reassembling the panels for subsequent reuse, but stray panels may also become easily lost or damaged.

Another disadvantage of the use of intersecting panels with nested slots and passive attachment means, is that the panels exhibit little natural tendency to intersect at prompted right angles, which is a common, if not most prevalent, desired region configuration.

It is thus an object of the present invention to provide a partition packing apparatus, capable of repeated use, and comprised of vertically extending intersecting primary and secondary panels which may be readily fixedly and disengageably assembled.

It is a further object of the subject invention to provide a partition packing apparatus for repeated use comprised of vertically intersecting panels which are actively restrainably affixed relative to one another to prevent loss or separation of individual panels, while describing distinct, rigid, containment and cushioning regions within a container.

It is also an object of the present invention to provide a partition packing apparatus for repeated use, which is easily installed during packing and removed during unpacking, yet which costs very little more to manufacture and assemble than conventional partition apparata.

An additional object of the present invention is the provision of a partition packing apparatus for repeated use, comprising vertically extending intersecting panels to effectively occupy the three dimensional cavity of a container through which intersecting primary and secondary panels are more effectively maintained at right angles to one another within the container—while affording the feature of modularity among consistently alignable locking structures on variably-sized panel elements.

These and other objects of the invention will become apparent in light of the present specification, drawings and claims.

SUMMARY OF THE INVENTION

The present invention comprises an assembled slotted partition apparatus for enabling the repeated use of such assemblies for packing and repacking operations within three-dimensional containers, towards describing containment and cushioning regions therewithin, in which the apparatus itself precludes against its own inadvertent disassembly between said repeated uses.

The apparatus comprises one or more primary interlocking panel means for positioning in the packing container along substantially first and second ones of the three dimensions. Each of the primary interlocking panel means includes a substantially flat primary panel member which has one or more panel slots arranged therewithin, together with one or more primary locking elements. Secondary interlocking panel means are operably attached to the one or more primary interlocking panel means for positioning of the secondary interlocking panel means, in the packing container, along substantially second and third ones of the packing container's three dimensions. Each of the secondary interlocking panel means cooperating with the primary interlocking panel means, is operably and telescopically received by and restrainably affixed within one or more of the primary panel slots respectively.

The secondary interlocking panel means itself comprises a substantially flat secondary spacer member having a spacer locking element capable of operable alignment and interlocking engagement with a respective one of the primary panel locking elements in the primary panel member. Upon the telescopic receipt and restrained affixation of the respective secondary spacer member within the primary panel slot, the interlocking of the one or more secondary interlocking panel means along one or more of the primary interlocking panel means, forms an intersecting three-dimensional array of fixedly positioned, geometrically shaped compartments within the packing container—to in turn accommodate the containment as well as the cushioning of articles positioned for shipment within the container. Furthermore, the interlocked positioning of the intersecting secondary spacer members fixedly attached along the primary interlocking panel member enable the removal of the slotted partition apparatus from the packing container intact and fully assembled. This construction further enables the replacement and reuse of the slotted partition apparatus, intact, still completely assembled, within the original and/or other packing containers, without reassembly and/or reattachment of the primary and secondary interlocking panel means to each other.

In the preferred embodiment of the invention, each of the primary locking elements is respectively positioned along each of the primary panel slots arranged within the primary panel member. In such an arrangement, the one or more primary panel slots are arranged within the primary panel member to form a series of primary blade elements, each of which primary panel blade element extends from the inperforate portion of the primary panel member, between each of the primary panel slots. In this embodiment further, the primary locking elements in the primary panel member comprises substantially protruding male tab elements, extending from each of the series of primary panel blade elements into and past the width of the respective adjacent primary panel slot. This construction enables the protruding male tab to cross each of the adjacent respective primary panel slots to ultimately nest in a notch region formed in the back of the next adjacent primary panel blade element. The protruding male tab extends from each primary panel blade element in a position substantially perpendicular to the longitudinal direction of each primary panel slot positioned immediately adjacent thereto.

The spacer locking element on the secondary interlocking panel means comprises a locking aperture in operable interlocking alignment with the protruding male tab on the primary panel blade element, upon assembly of the slotted partition apparatus. In this configuration, the protruding male tab penetrates through the locking aperture to fixedly restrain the position of the entire secondary interlocking panel means relative to the primary interlocking panel means.

In the preferred embodiment of the invention, all of the primary panel blade elements emanating from the primary panel member, the primary panel member itself, the protruding male tabs and nesting notch regions into which the protruding male tabs extend, are all fabricated from an integral single sheet of partition material—from which the overall primary interlocking panel means is formed.

The secondary interlocking panel means further includes a secondary panel slot for operable positioning in interlocked fashion with the respective primary panel slot in the primary panel member. The primary and secondary panel slot cooperate with each other to telescopically slide past one another upon assembly of the slotted partition apparatus, with the closed ends (bottoms) of the respective slots being substantially juxtaposed adjacent one another, upon alignment of the respective primary locking element with the respective spacer locking element. In this embodiment, the primary panel slots and primary locking elements in the primary interlocking panel means, together with the spacer locking elements of the secondary interlocking panel means, are all positioned on a first side of the assembled slotted partition apparatus, with the secondary panel slot in the secondary interlocking panel means being positioned on a second side of the assembled slotted partition apparatus—which second side is substantially opposite to said first side. In this embodiment also, each of the primary and secondary interlocking panel means are substantially of the same height so as to define a consistently high three dimensional slotted partition apparatus for repeated use in said packing containers. The length of the secondary panel slot in the secondary interlocking panel means, when added to the length of the primary panel slot in said one or more primary panel members, totals to a value substantially equal to the overall height of both the primary and secondary interlocking panel means, in the overall assembled partition apparatus. Preferably, the primary panel slots arranged within the primary panel member are substantially parallel to each other. The secondary panel slots and the secondary interlocking panel means being telescopically received and restrainably affixed within the one or more primary panel slots, are also in substantial parallel orientation relative to each other, with all of the secondary interlocking panel means, upon assembly into the slotted partition apparatus, being restrained in a position substantially perpendicular to the primary interlocking panel means.

In another embodiment of the invention, each of the assembled slotted partition apparata, includes a plurality of primary interlocking panel means, in which each of said plurality of primary interlocking panel means intersects with two or more elongated ones of the secondary interlocking panel means to, in turn, create a geometrically-shaped array of containment and cushioning regions. In this alternative embodiment, at least one of the containment and cushioning regions is completely surrounded on all its peripheral sides by portions of immediately adjacent primary and secondary interlocking panel means respectively.

The preferred embodiments of the invention contemplate the primary and secondary interlocking panel means themselves as comprising substantially rectangular-shaped regions of partition material, in which the primary and secondary interlocking panel means are constructed, preferably, of a corrugated cardboard material.

DETAILED DESCRIPTION OF THE DRAWINGS

Figure 1:
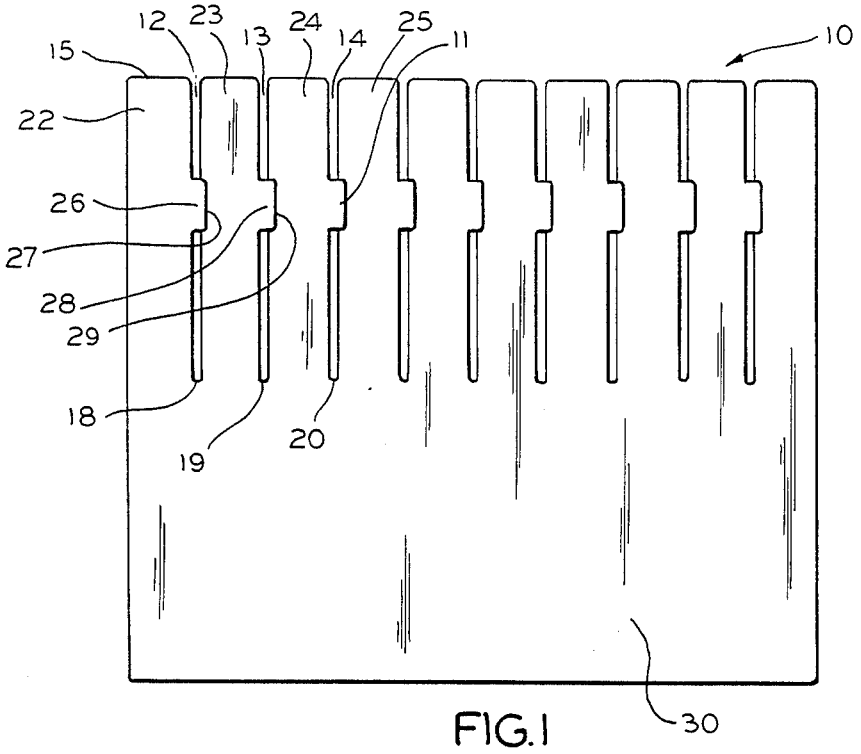
FIG. 1 of the drawings is an elevated side view of the primary interlocking panel means, according to a first embodiment of the present invention, displaying its plurality of panel blade elements, panel slots and corresponding tabbed and notched locking elements.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Primary interlocking panel 10 is shown in FIG. 1 as including primary panel member 30 from which primary panel blade elements 22 through 25 emanate. Primary panel slots 12, 13 and 14 between blade elements 22 through 25 respectively, are also shown in FIG. 1 with respective slot bottoms 18, 19 and 20. Protruding tab 26 is additionally shown as emanating from primary blade element 22 into notched region 27 formed in the back of blade element 23. In like fashion protruding tab 28 emanating from blade element 23 nests in notched region 29 of blade element 24, which itself possesses protruding tab 11. As further shown in FIG. 1, each respective protruding tab element, such as tab elements 26, 28 and 11, cross over the width of their respective proximate panel slots, as shown by protruding tab 26 completely crossing primary panel slot 12, protruding tab 28 crossing panel slot 13 and protruding tab 11 crossing primary panel slot 14—with each respective tab nesting in the next adjacent notch of the next successive primary panel blade element. Also shown in FIG. 1 is top edge 15 of primary panel member 30.

Primary panel 10, as shown in FIG. 1, is substantially rectangularly shaped with its primary panel blade elements additionally being substantially rectangularly shaped. Moreover, in the preferred embodiment of the invention primary interlocking panel 10, as well as the other cooperating panels described hereinbelow, are preferably fabricated of a corrugated cardboard material or alternatively of plastic, wood or cardstock of varying gauge.

Figure 2:
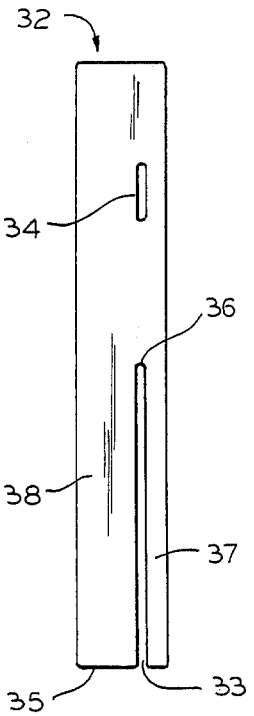
FIG. 2 is an elevated front view of the secondary interlocking panel spacer member displaying particularly its secondary panel slot and associated spacer locking aperture.

Secondary panel 32 is shown in FIG. 2 as comprising a substantially rectangularly shaped secondary spacer member 38 having bottom surface 35, secondary panel slot 33, with panel slot and (bottom) 36 and secondary spacer locking element 34—here an aperture capable of telescopically receiving protruding male tab element from primary interlocking panel means 10. Through such a construction, primary interlocking panel 10 of FIG. 1 is capable of and configured to receive a plurality of secondary spacer panels as exemplified by secondary interlocking panel 32 of FIG. 2. And as described with regard to primary panel 10, secondary interlocking panel 32 is preferably constructed of a thin rectangular sheet of suitable material such as plastic, wood, cardstock or, preferably, corrugated cardboard.

Figure 3:
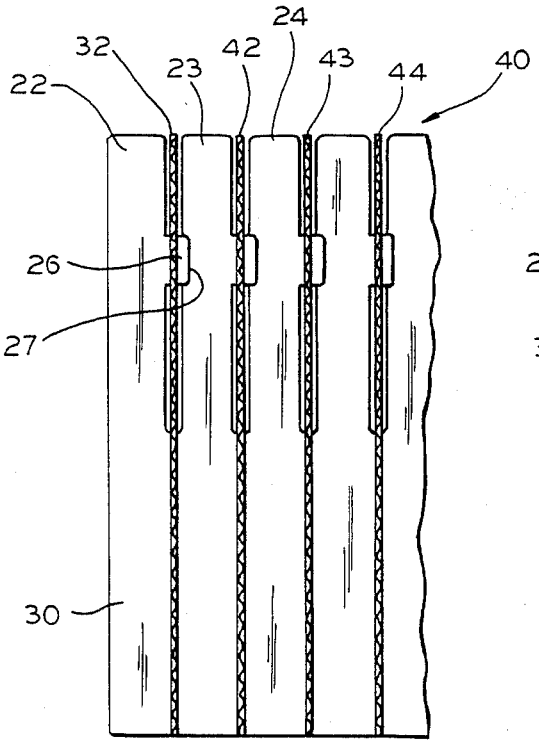
FIG. 3 is an elevated side view of an assembled interlocking slotted partition apparatus, according to a first embodiment of the present invention, in which the primary and secondary panel means of FIGS. 1 and 2 respectively, have been assembled and articulated into a three-dimensional modular container insert.

Primary interlocking panel 10 and a plurality of secondary interlocking panels, including secondary interlocking panel 32, have been assembled as shown in FIG. 3 in which secondary interlocking panels 32, 42, 43 and 44 are shown locked and restrainably affixed to the primary interlocking panel 10 of FIG. 1. As shown in FIG. 3, secondary spacer member 32 is locked in position through the protrusion of male tab 26 through spacer locking aperture 34, crossing slot 12 and nesting in notch 27 of blade element 23. In like fashion, protruding tabs emanating from blade elements 23, 24 and so on cross the slotted regions immediately adjacent thereto to simultaneously penetrate the respective spacer locking apertures in the other secondary interlocking panel members, such as panel members 42, 43 and 44. The assembled articulated configuration of assembled partition apparatus 40, as shown in FIG. 3, contemplates not only nesting of the primary and secondary interlocking panel members about the primary panel slots 12 through 14 (pictured in FIG. 1), together with the locking elements 26, 28 and 11 in their respective spacer locking apertures of the secondary panels, but also contemplates the sliding of the secondary panel slots such as slot 33 in secondary panel 32, over the imperforate portion of the primary panel member 30 with the bottoms of the primary panel slots such as bottoms 18 through 20 respectively meeting with the bottoms of the secondary panel slots, such as secondary panel slot 3.

Figure 4:
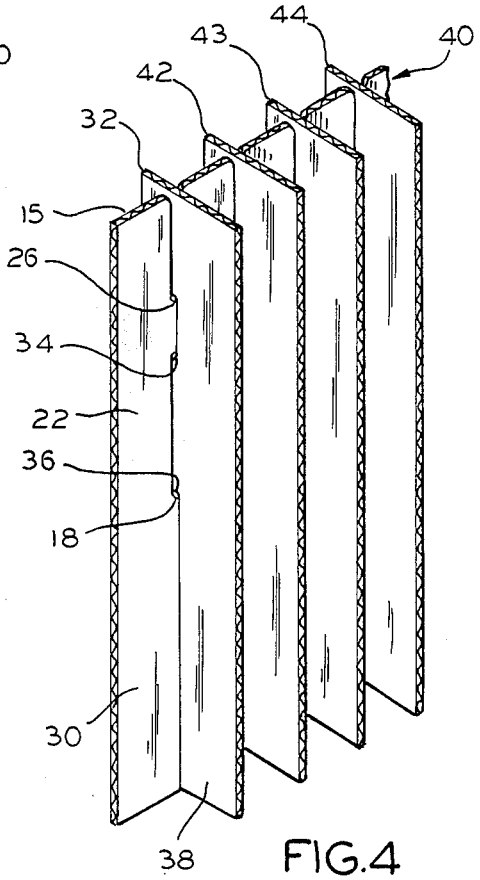
FIG. 4 is a perspective view of the assembled interlocking slotted partition apparatus of FIG. 3.

Indeed, in FIG. 4, secondary panel slot bottom 36 is shown substantially juxtaposed to primary panel slot bottom 18 of primary panel slot 12 where these slots permit each of the primary and secondary panels to slide past each other during assembly until such time as the locking tab elements, including protruding locking tab 26, correspond in alignment to locking apertures such as aperture 34, in secondary panel member 32. Also shown in FIG. 4 are the corresponding restrained and affixed positions of secondary panel members (spacer members) 42 through 44 along primary interlocking member 30, between blade elements 22, 23, 24 and 25 (of FIG. 1) respectively—so as to create an assembled articulated slotted partition apparatus 40 which is capable of creating appropriate containment and cushioning regions within a box through description of a substantially three dimensional partition array.

The thin rectilinear slotted shapes of (a) locking aperture 34, relative to the shape and thickness of protruding tab 11; (b) primary panel slot 12 relative to the thickness of secondary panel 32; and (c) of secondary panel slot 33 relative to the thickness of primary panel member 30, as shown in FIGS. 1–4 and as mentioned hereinabove, prompts not only secure attachment between the articulated components of the apparatus, but also promotes and maintains the primary and secondary panels at right angles relative to each other.

Figure 5:
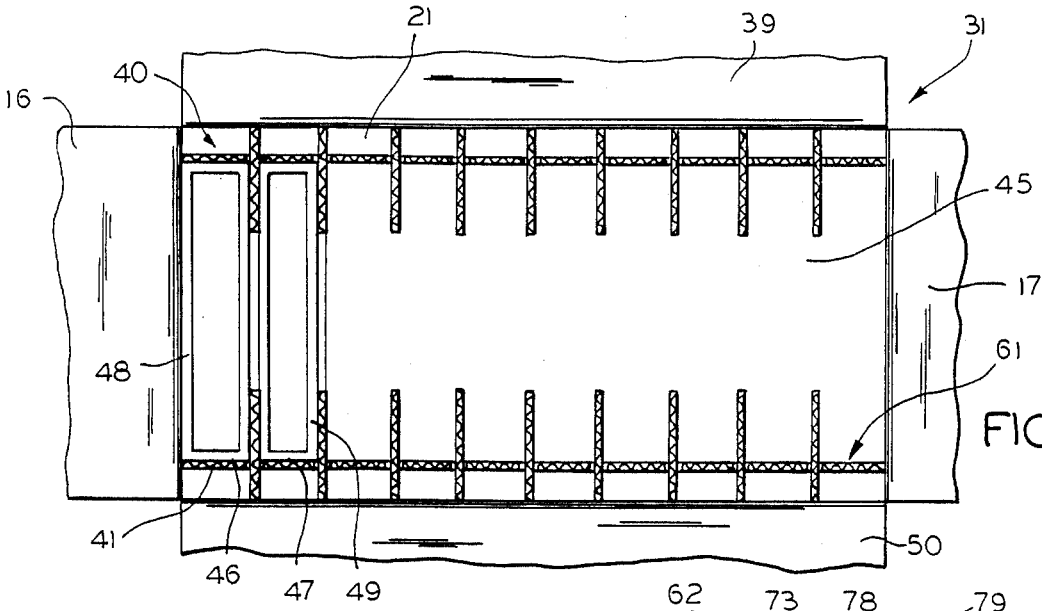
FIG. 5 is a top plan view of two aligned interlocking slotted partition apparata, according to FIGS. 3 and 4, shown operably deployed within an open, flapped shipping container.

Two assembled interlocking partition apparata 40 and 61 are shown positioned within the interior of shipping container 31 in FIG. 5. Through positioning and alignment of these specially constructed partitions, a series of three dimensional containment regions, such as the regions occupied by shipping articles 48 and 49, as well as cushioning regions such as cushion region 21 proximate to carton flap 39, are thereby formed. Also shown in FIG. 5 are primary panel member 41 in interlocking partition apparatus 61 together with carton interior 45, and carton flaps 16, 17 and 50.

Figure 7:
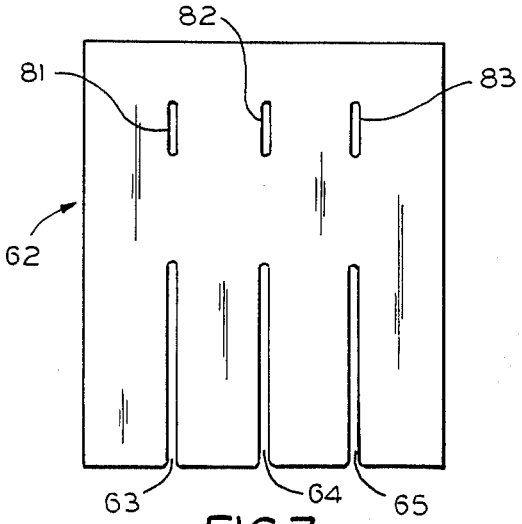
FIG. 7 is an elevated front view of a secondary interlocking panel means, for integration into the primary panel of FIG. 6, in said alternative embodiment of the invention, which secondary panel includes a plurality of secondary slots and a plurality of spacer locking members.
Figure 6:
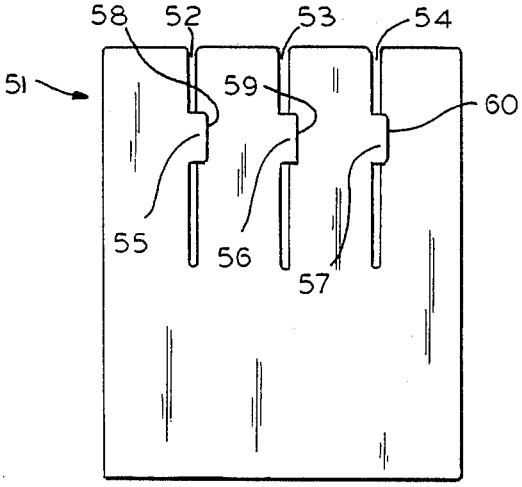
FIG. 6 is an elevated side view of a primary interlocking panel means, for assembly into an alternative embodiment of the present invention, in which a plurality of primary panels cooperate with a plurality of secondary panels to create an array of containment and cushioning regions.

FIGS. 6 through 9 of the drawings show another embodiment of the invention in which each interlocking slotted partition apparatus includes not only a plurality of secondary spacer members, but also a plurality of primary interlocking panel means as well. FIG. 6 particularly shows primary interlocking panel means 51 as embodying a series of panel blade elements, each of which has a protruding male tab such as protruding male tabs 55, 56 and 57 to cross the adjacent slots 52 through 54 respectively, towards nesting in notch regions 58, 59 and 60 respectively. In FIG. 7 a secondary "spacer" panel means is shown which includes a plurality of secondary slots 63, 64 and 65, together with a plurality of spacer locking apertures 81 through 83. Through such a configuration the secondary panel 62 can be joined to a plurality of primary interconnecting panel means, such as exemplified by panel means 51 of FIG. 6, to create a uniform or intentionally nonuniform array of containment and cushioning regions—where at least one or more of the containment and/or cushioning regions is completely surrounded on all its peripheral sides by portions of immediately adjacent primary and/or secondary interlocking panel means. By way of exemplification, FIG. 8 of the drawings shows, in perspective, slotted partition apparatus 70 as assembled by articulated primary panel means 51, 71 and 72 operably and restrainably attached to secondary interlocking panel means 62, 73 and 74 respectively, so as to form a fully assembled slotted partition apparatus which, upon fixed interlocked assembly precludes against its own inadvertent disassembly between and during repeated uses in shipping containers. Through such a construction, the primary and secondary interlocking panel members enable the intact removal of the slotted partition apparatus from the packing container, intact and in a fully assembled fashion, to further enable its replacement and reuse within either its original or another packing container, without any reassembly and/or reattachment of the primary and secondary interlocking panel means embodying same.

Figure 9:
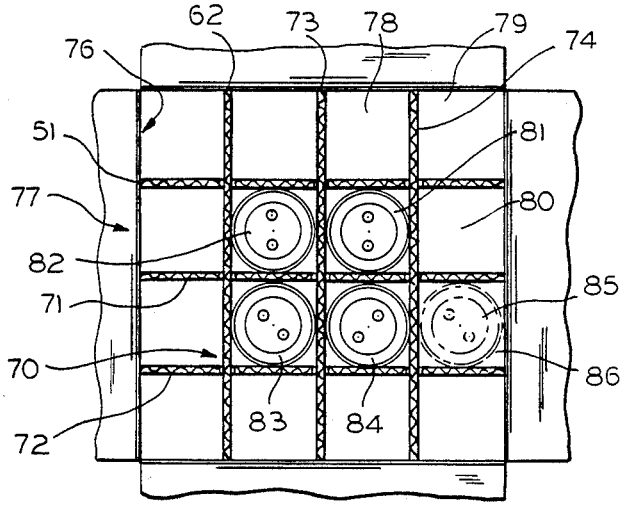
FIG. 9 is a top plan view of the assembled reusable interlocking slotted partition of FIG. 8 deployed within the interior of an open flapped shipping container, to create a row and column array of containment and/or cushioning regions therewithin.
Figure 8:
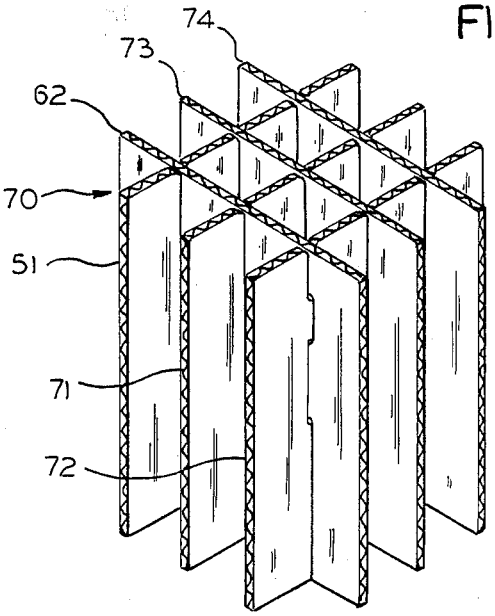
FIG. 8 is a perspective view of the assembled interlocking slotted partition apparatus, according to said alternative embodiment of the invention, depicting the interlocking primary and secondary panels of FIGS. 6 and 7 hereinabove.

In FIG. 9 the assembled slotted partition apparatus 70 of FIG. 8 is shown in place within shipping carton 77, and particularly within interior 76 formed thereby. As can be seen, secondary panels 62, 73 and 74, each with their plurality of secondary slots and spacer locking elements, is capable of being fixedly attached to a plurality of primary interlocking panel means, in this case, interlocking panels 51, 71 and 72 respectively. Through such intersection and attachment, an array of containment regions is formed such as regions 78 and 80 which may be utilized for purposes of containing actual articles for shipping such as fluorescent tube articles 81 through 85, or may alternatively be utilized for cushioning of articles being shipped in a closed container where regions 78, 80 and 86, for example, would remain empty of any shipped articles. It is readily observed that by varying the numbers of primary and secondary interlocking panels, and by varying the numbers of slots in same, interlocking slotted partition apparata of many different geometries may be obtained, including geometries where containment regions vary in size intentionally. As long as alignment of slots and locking elements is maintained, inventories of separately sized and slotted panels may be integrated, modularly, into partitions of any desired size and geometry. Moreover, the tendency toward perpendicular orientation between the primary and secondary interlocking panels apparent in the first embodiment described hereinabove, is yet further enhanced in the second embodiment of FIGS. 6 through 9, with outstanding stability and securement characteristics provided by the interlocking features of the present invention.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An assembled slotted articulate partition apparatus for repeated use within three-dimensional packing containers towards describing containment and cushioning regions therewithin, which apparatus further precludes against its own inadvertent disassembly between and during said repeated uses, said apparatus comprising:

one or more primary interlocking panel means for positioning in said packing container along a substantially first and second of said three-dimensions, at least one of said one or more primary interlocking panel means including a substantially flat primary panel member having at least one primary panel slot arranged therewithin, together with at least one primary locking element;

said at least one primary locking element being respectively positioned along said at least one primary panel slot arranged within said primary panel member, one or more secondary interlocking panel means for operable attachment to and articulation with primary panel members, for positioning of said one or more secondary interlocking panel means, in said packing container along a substantially second and third of said three-dimensions, said at least one primary panel slot in said primary panel member comprising a substantially vertically oriented, rectilinearly shaped slot configured to a width substantially equal to the thickness and shape of said one or more secondary interlocking panel means, said at least one primary panel slot being arranged within said primary panel member to form a plurality of adjacent primary panel blade elements, at least one of said plurality of primary panel blade elements extending from said primary panel member, on each side of said at least one primary panel slot, said at least one primary locking element in said primary panel member comprising a substantially protruding, rigid male tab element extending from at least one of said plurality of adjacent panel blade elements, into and past the width of said respective adjacent primary panel slot, so as to enable said protruding male tab element to cross said adjacent respective primary panel slot to ultimately nest in a notch region formed in the back of said adjacent primary panel blade element, said protruding male tab element extending in restrained orientation from at least one of said plurality of primary panel blade elements, in a direction substantially perpendicular to the longitudinal position of said at least one primary panel slot positioned immediately adjacent thereto, said one or more secondary interlocking panel means operably and telescopically received by and restrainably affixed within said at least one primary panel slot respectively, upon transverse displacement of the plurality of primary panel blade elements immediately adjacent said at least one primary panel slot, said one or more secondary interlocking panel means further comprising a substantially flat secondary spacer member having a spacer locking element capable of operable alignment and interlocking engagement with a respective one of said at least one primary locking element in said primary panel member, upon said telescopic receipt and restrained affixation of said respective secondary spacer member within one of said at least one primary panel slot upon said articulation of the slotted partition apparatus, said spacer locking element on said one or more secondary interlocking panel means comprising a locking aperture in operable interlockable alignment with said protruding male tab element extending from said respective primary panel blade element, upon said articulation of the slotted partition apparatus, said protruding male tab element protruding through said respective locking aperture to fixedly restrain the position of said one or more secondary interlocking panel means relative to said one or more primary interlocking panel means, said locking aperture in said one or more secondary interlocking panel means being substantially vertically oriented, rectilinearly shaped, and configured to a width substantially equal to the thickness and shape of said respective protruding male tab element protruding therethrough, said one or more secondary interlocking panel means further including at least one secondary panel slot for operable positioning in interlocked fashion with a respective primary panel slot in said primary panel member, said at least one primary panel slot co-operating with said at least one secondary panel slot to slide past one another, upon articulation of said slotted partition apparatus, with the bottoms of said respective primary and secondary panel slots being substantially juxtaposed adjacent one another, upon alignment of said respective primary locking element with said respective spacer locking element, said at least one secondary panel slot in said one or more secondary interlocking panel means being substantially vertically oriented, rectilinearly shaped, and configured to a width substantially equal to the thickness and shape of said primary panel member juxtaposed thereto upon said articulation, the juxtapositioning and shape of said at least one primary panel slot relative to said one or more secondary interlocking panel means, of said locking aperture relative to said respective protruding male tab element protruding therethrough, and of said at least one secondary panel slot relative to said respective primary panel member, upon articulation, respectively prompting and maintaining said one or more primary and secondary interlocking panel means at right angles relative to one another, so as to, in turn, facilitate the deployment and description of said containment and cushioning regions therewithin said packing container, said interlocking of said one or more secondary interlocking panel means along said one or more primary interlocking panel means forming, upon articulation, an intersecting three-dimensional array of fixedly positioned, geometrically-shaped compartments within said packing container, to in turn accommodate said containment as well as the cushioning of said articles therewithin said container, the interlocked positioning of said intersecting secondary spacer members fixedly attached along said one or more primary interlocking panel means enabling the removal of said slotted partition apparatus from said packing container, intact and in a fully assembled fashion, and further enabling the replacement and reuse of the apparatus, intact, in a completely assembled fashion, within said and other packing containers, without reassembly and reattachment of the one or more primary and secondary interlocking panel means thereof.

2. The invention according to claim 1 in which said plurality of primary panel blade elements emanating from said primary panel member, said primary panel member itself, said protruding male tab element extending from at least one of said plurality of adjacent primary blade elements, and said nesting notch region into which said protruding male tab element extends, further comprise an integral single sheet of partition material from which said one or more primary interlocking panel means is formed.

3. The invention according to claim 1 in which said at least one primary panel slot, and said at least one primary locking element in said one or more primary interlocking panel means, together with said spacer locking element, of said one or more secondary interlocking panel means, respectively, are all positioned on a first side of said assembled slot partition apparatus, said at least one secondary panel slot in said one or more secondary interlocking panel means being positioned on a second side of said assembled slotted partition apparatus, which second side is opposite to said first side.

4. The invention according to claim 3 in which each of said one or more primary and secondary interlocking panel means are substantially of the same height so as to define a consistently high three-dimensional slotted partition apparatus for said repeated use in said packing containers, the length of said at least one secondary panel slot in said one or more secondary interlocking panel means, in combination with the length of said at least one primary panel slot in said one or more primary interlocking panel means, respectively totalling to a value substantially equal to the overall height of both said one or more primary and secondary interlocking panel means in said overall assembled slotted partition apparatus.

5. The invention according to claim 1 in which said one or more primary interlocking panel means includes a plurality of primary panel slots, each of said plurality of primary panel slots arranged therewithin said primary panel member being substantially parallel to the other ones of said plurality of primary panel slots, said at least one secondary panel slot in said one or more secondary interlocking panel means being telescopically received and restrainably affixed within said at least one primary panel slot respectively, in substantially parallel orientation relative to each other, said one or more secondary interlocking panel means, upon articulation into said slotted partition apparatus, being restrained in a position substantially perpendicular to said one or more primary interlocking panel means.

6. The invention according to claim 1 in which said assembled slotted partition apparatus includes a plurality of primary interlocking panel means, each one of said plurality of primary interlocking panel means intersecting with two or more elongated one of said secondary interlocking panel means so as to create a geometrically shaped array of containment and cushioning regions in which at least one of said containment and cushioning regions is completely surrounded on all its peripheral sides, by portions of immediately adjacent primary and secondary interlocking panel means.

7. The invention according to claim 1 in which both said one or more primary and secondary interlocking panel means comprise substantially rectangularly shaped regions of partition material.

8. The invention according to claim 1 in which both said one or more primary and secondary interlocking panel means comprise members of corrugated cardboard material.

* * * * *

UNITED STATES PATENT AND TRADEMARK OFFICE

CERTIFICATE OF CORRECTION

PATENT NO. : 4,795,083

DATED : January 3, 1989

INVENTOR(S) : David A. Johnske

It is certified that error appears in the above-identified patent and that said Letters Patent is hereby corrected as shown below:

| | |
|---|---|
| Col. 6, line 28 | After "slot" delete "3" and insert instead -- 33 -- |
| Col. 8, line 11 | After "slotted" delete "articulate" and insert instead -- articulable -- |

Signed and Sealed this

Seventeenth Day of April, 1990

*Attest:*

HARRY F. MANBECK, JR.

*Attesting Officer*

*Commissioner of Patents and Trademarks*